US006915791B2

(12) United States Patent
Harwath et al.

(10) Patent No.: US 6,915,791 B2
(45) Date of Patent: Jul. 12, 2005

(54) APPARATUS FOR LOADING A MOVEABLE ARROW REST

(75) Inventors: Frank A. Harwath, Downers Grove, IL (US); Miroslav A. Simo, Riverside, IL (US)

(73) Assignee: New Archery Products Corp., Forest Park, IL (US)

( * ) Notice: Subject to any disclaimer, the term of this patent is extended or adjusted under 35 U.S.C. 154(b) by 0 days.

(21) Appl. No.: 10/345,830

(22) Filed: Jan. 16, 2003

(65) Prior Publication Data

US 2004/0139953 A1 Jul. 22, 2004

(51) Int. Cl.[7] ..... F41B 5/22
(52) U.S. Cl. ..... 124/44.5
(58) Field of Search ..... 124/24.1, 44.5, 124/90, 91

(56) References Cited

U.S. PATENT DOCUMENTS

| | | | | |
|---|---|---|---|---|
| 4,453,528 A | | 6/1984 | Eckert | |
| 4,685,439 A | | 8/1987 | Cosentino, Jr. | |
| 4,803,971 A | | 2/1989 | Fletcher | |
| 5,365,912 A | | 11/1994 | Pittman | |
| 5,390,657 A | * | 2/1995 | Larson | 124/91 |
| 5,394,858 A | | 3/1995 | Karolian | |
| 5,415,154 A | | 5/1995 | Angeloni | |
| 5,490,492 A | | 2/1996 | Savage | |
| 5,522,375 A | | 6/1996 | Simo et al. | |
| 5,632,263 A | | 5/1997 | Sartain | |
| 5,722,381 A | | 3/1998 | Mizek | |
| 5,743,245 A | | 4/1998 | Mizek | |
| 6,044,832 A | | 4/2000 | Piersons, Jr. | |
| 6,050,251 A | | 4/2000 | Harwath et al. | |
| 6,089,216 A | | 7/2000 | Harwath et al. | |
| 6,102,020 A | | 8/2000 | Mizek et al. | |
| 6,202,635 B1 | | 3/2001 | Evans | |
| 6,615,813 B1 | | 9/2003 | Troncoso, Jr. et al. | |
| 6,634,349 B2 | | 10/2003 | Mizek et al. | |

OTHER PUBLICATIONS

*The Bowman's Not So Ordinary Archery Catalog*, Internet Publication, pp. 1 of 4–3 of 4, Dec. 27, 2001.
*Lexco, Internet Publication*, pp. 1 of 3–3 of 3, Jan. 15, 2002.

* cited by examiner

*Primary Examiner*—John A. Ricci
(74) *Attorney, Agent, or Firm*—Pauley Petersen & Erickson

(57) ABSTRACT

A moveable arrow rest having a support element that moves between an unloaded position and a loaded position, with respect to an archery bow. The archery bow has a bow cable. A cam element is fixed with respect to the bow cable. A lever is fixed with respect to the support element. A cam surface of the cam element contacts the lever and translates movement of the bow cable into movement of the support element.

19 Claims, 9 Drawing Sheets

APPARATUS FOR LOADING A MOVEABLE ARROW REST

BACKGROUND OF THE INVENTION

1. Field of the Invention

This invention relates to an apparatus for moving an arrow rest between an unloaded position and a loaded position, using a cam element fixed with respect to a bow cable.

2. Discussion of Related Art

Many conventional moveable arrow rests are forced into an unloaded position where the arrow rest is at a far enough distance away from a discharging arrow shaft. However, the arrow shaft and the fletching will clear the arrow rest only if the arrow rest is able to move away from the arrow quickly enough to avoid interference with the arrow.

In conventional drop-away or move-away arrow rests, the arrow rest is normally biased or otherwise forced into the unloaded position. Some conventional arrow rests use a rigid mechanical linkage between a bow cable and the arrow rest, which has a relatively fast response time for moving the arrow rest away but such mechanical linkages are relatively intricate, complex and/or cumbersome.

Other conventional arrow rests use a flexible elastic member as a mechanical link between the bow cable and the arrow rest. The flexible elastic member, such as a polymeric or rubber tube, forms a relatively simple mechanical structure. However, the response time for returning the arrow rest to the unloaded position upon discharge of an arrow shaft is so slow that the arrow rest does not move away in sufficient time for the arrow shaft and/or the fletching to clear the arrow rest. In such conventional arrow rests, the flexible elastic member must decrease significantly in length before the bias force returning the arrow rest to the unloaded position can overcome the tension in the flexible elastic member.

There is an apparent need for a relatively rigid mechanical linkage between a bow cable and a moveable arrow rest, which provides instantaneous or immediate movement of the arrow rest away from the arrow shaft when the arrow is discharged from the archery bow.

SUMMARY OF THE INVENTION

It is one object of this invention to provide a relatively simple mechanical linkage which can be used to instantaneously or immediately move an arrow rest away from a discharging arrow shaft, when an arrow is discharged from an archery bow.

It is another object of this invention to provide a linkage between a bow cable and an arrow rest that can accommodate non-linear or three-dimensional movement of an attachment point between the linkage and the bow cable.

The arrow rest according to this invention has a support element that moves between an unloaded position and a loaded position, with respect to an archery bow. In the unloaded position, the support element is at a sufficient distance away from the arrow to clear both the arrow shaft and the fletching upon discharge of an arrow. In the loaded position, the support element holds the arrow shaft in a discharge position, ready for firing or discharge from the archery bow.

In one embodiment of this invention, a cam element is fixed with respect to the bow cable. The cam element can have an overall cylindrical shape or any other suitable shape that accommodates attachment to a bow cable as well as provides a cam surface.

A suitable follower or following device is fixed with respect to the support element. In one embodiment of this invention, the following device is a lever or elongated body.

The cam surface of the cam element contacts the lever. Thus, as the bow cable moves in a direction generally parallel to a longitudinal axis of the bow cable, the cam surface contacts the lever.

In one embodiment of this invention, the lever has a fork configuration. The bow cable rides within a void formed by the lever, such as between prongs of the fork configuration. The void is preferably shaped and sized so that the bow cable does not contact the lever when the support element moves between the unloaded position and the loaded position.

The relatively simple cam and follower linkage of this invention provides a rigid, durable, simple and relatively inexpensive apparatus that instantaneously or immediately returns the arrow rest to the unloaded position when the cable moves during discharge of the arrow from the archery bow.

BRIEF DESCRIPTION OF THE DRAWINGS

The above and other features and objects of this invention will be better understood from the following detailed description taken in view of the drawings, wherein.

DESCRIPTION OF PREFERRED EMBODIMENTS

Figure 1:
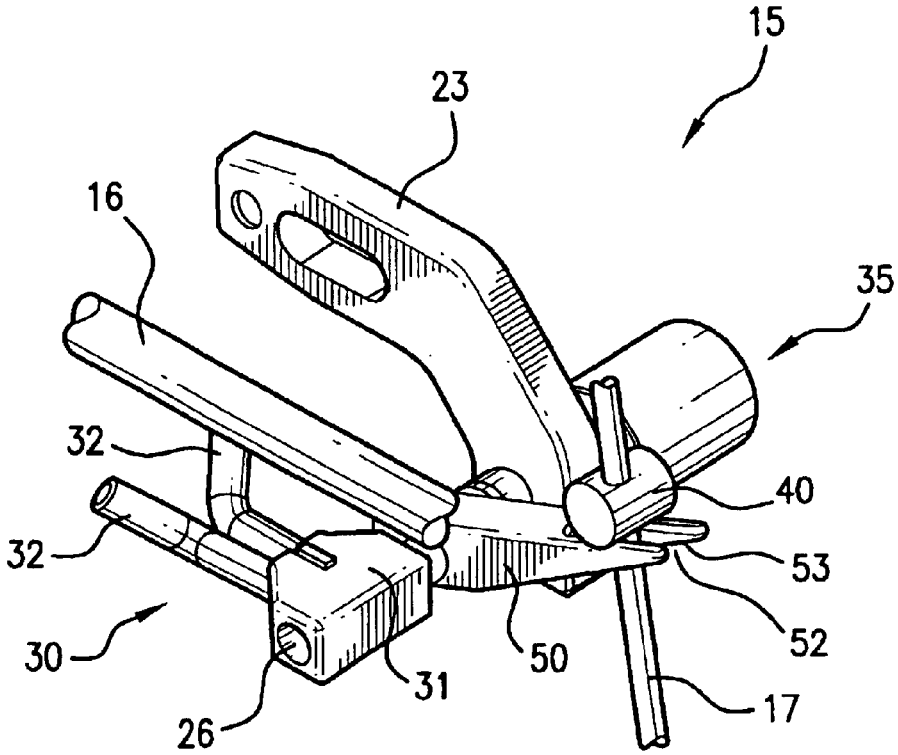
FIG. 1 is a perspective view of a moveable arrow rest, in an unloaded position, according to one embodiment of this invention.
Figure 2:
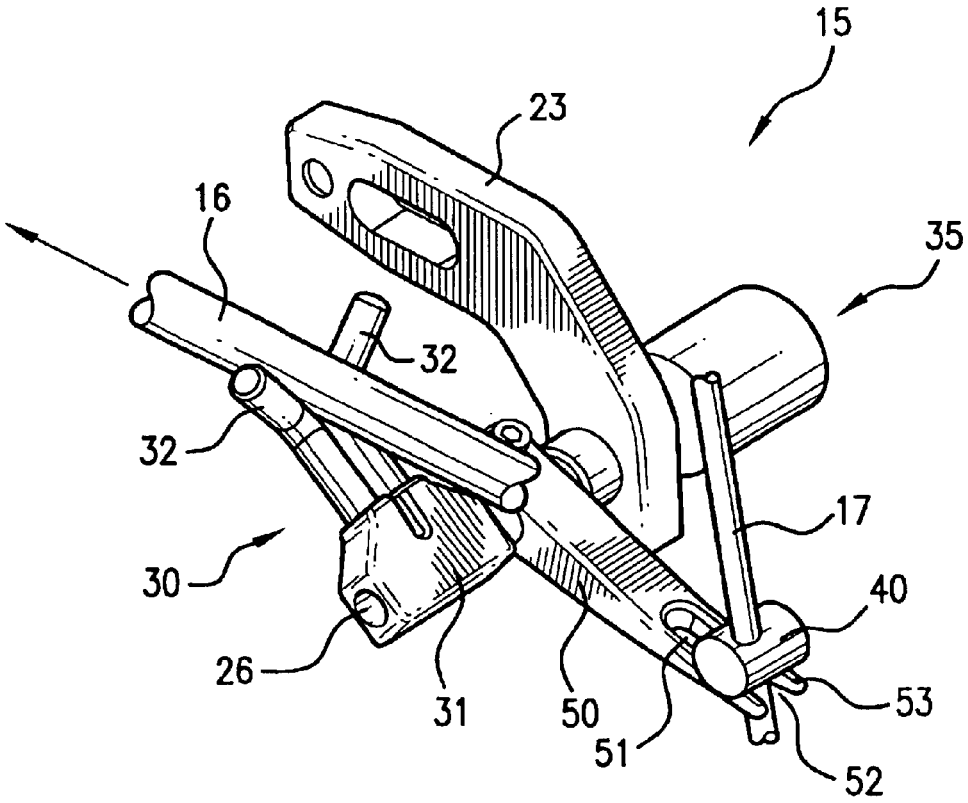
FIG. 2 is a perspective view of the arrow rest shown in FIG. 1, but in a loaded position.
Figure 3:
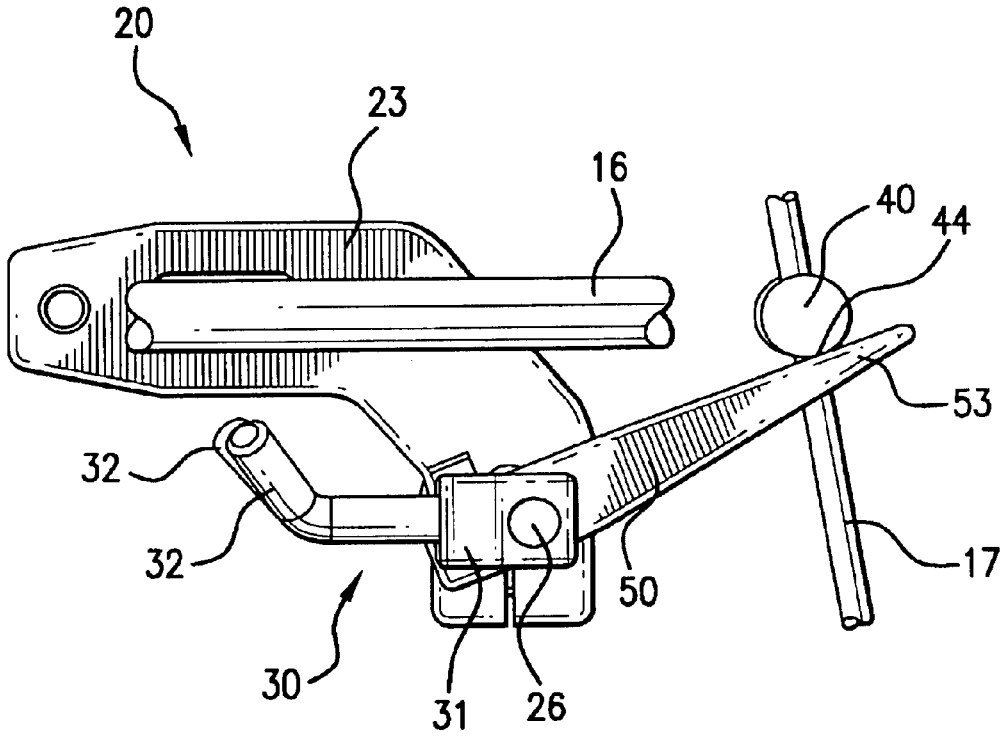
FIG. 3 is a side view of the arrow rest as shown in FIG. 1, in the unloaded position.
Figure 4:
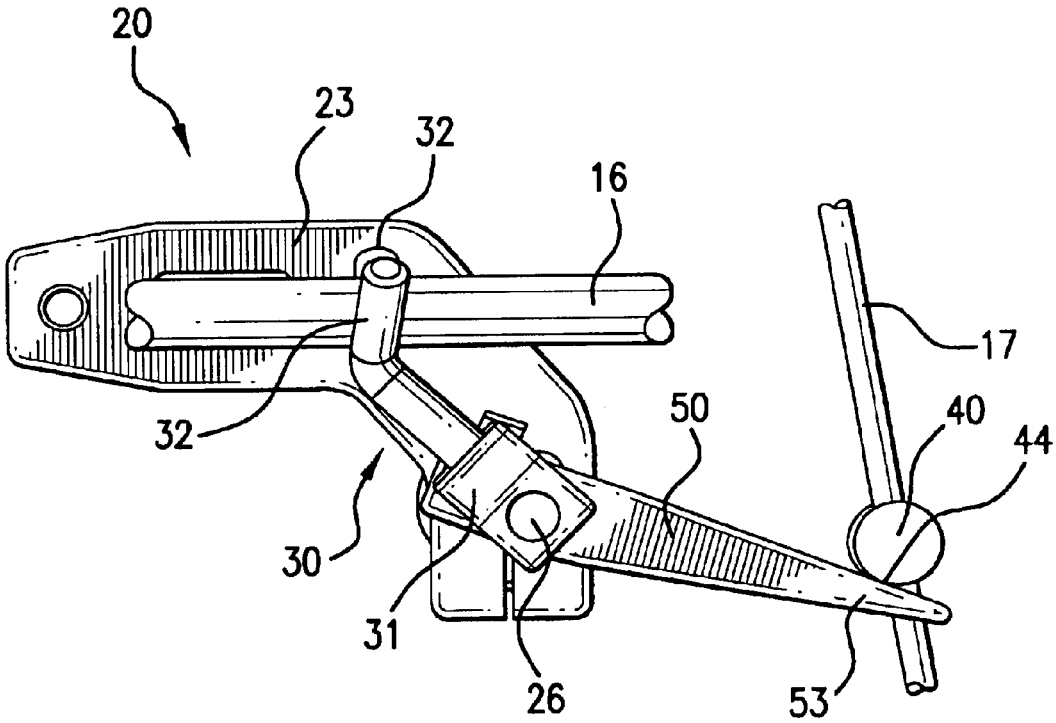
FIG. 4 is a side view of the arrow rest as shown in FIG. 2, in the loaded position.
Figure 5:
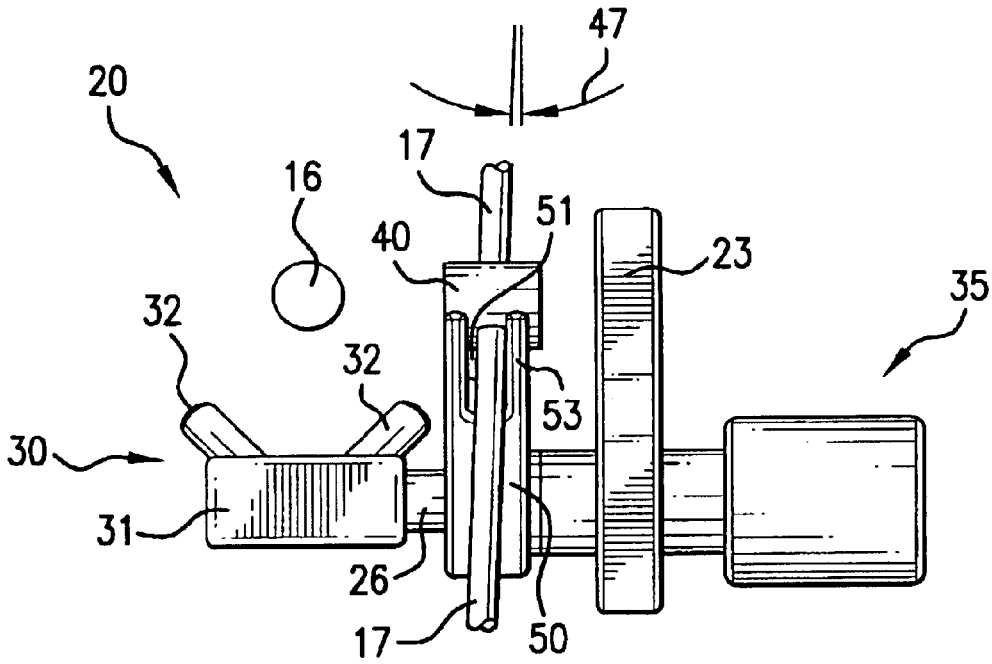
FIG. 5 is a rear view of the arrow rest shown FIG. 1, in the unloaded position.
Figure 6:
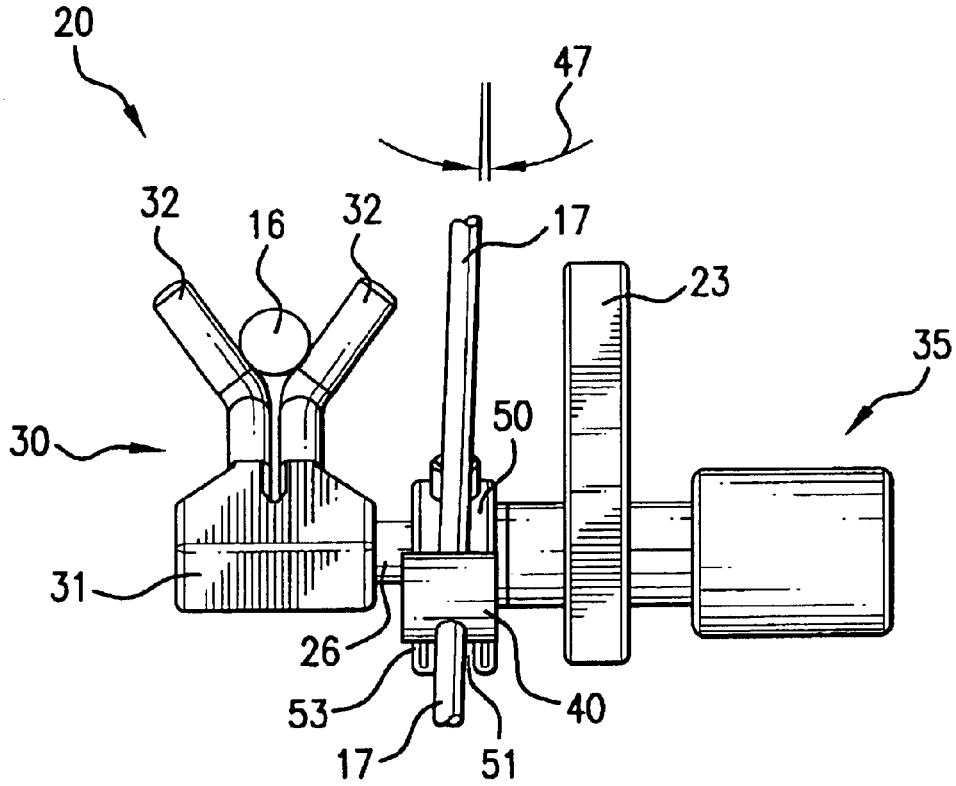
FIG. 6 is a rear view of the arrow rest shown in FIG. 2, in the loaded position.
Figure 7:
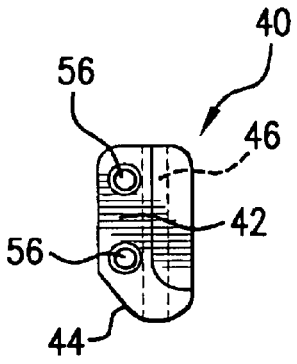
FIG. 7 is a side view of a cam element, according to one embodiment of this invention.

FIGS. 1 and 2 show perspective views of arrow rest 20, according to one embodiment of this invention. FIG. 1 shows arrow rest 20 in an unloaded position where support element 30 is pivoted or moved into an unloaded position. As shown in FIGS. 1, 3 and 5, in the unloaded position, arrow 16 does not contact support element 30. FIG. 2 shows arrow rest 20 in a loaded position. As shown in FIGS. 2, 4 and 6, when in the loaded position, arrow 16 contacts support element 30.

Figure 21:
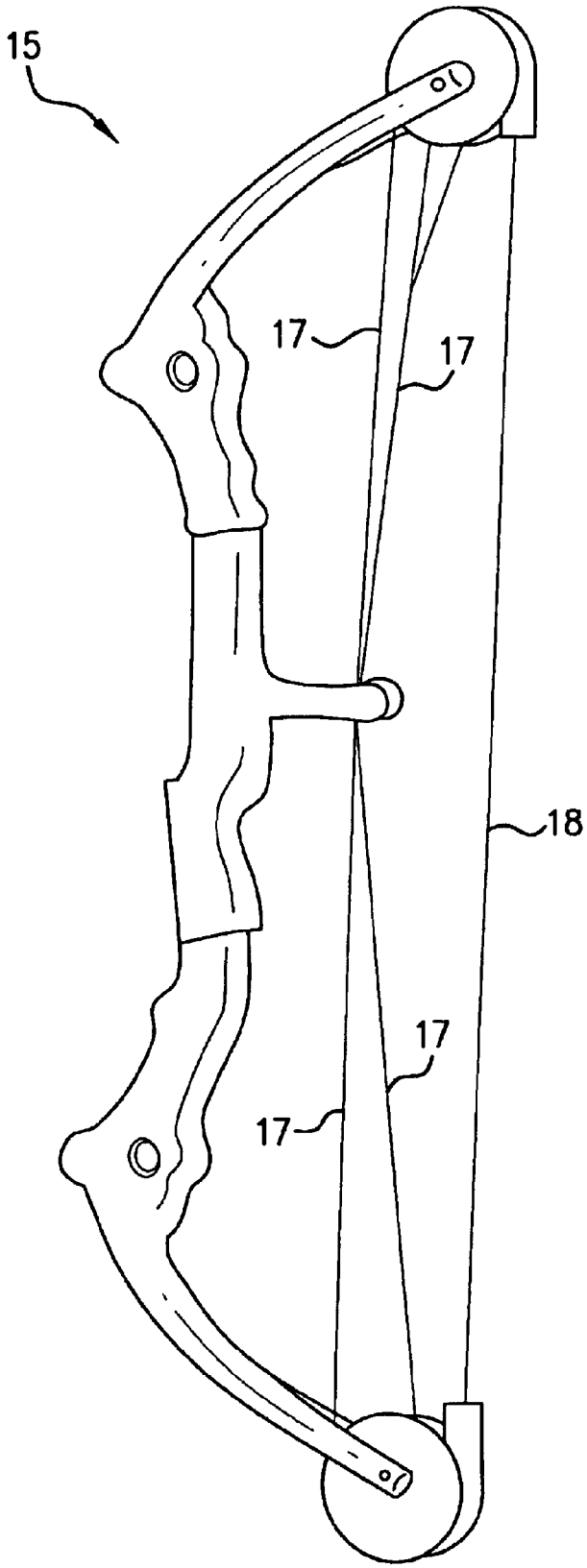
FIG. 21 is a schematic view of an archery bow to which a moveable arrow rest according to this invention can be mounted.

As shown in FIGS. 1–6, arrow rest 20 of this invention has support element 30 that pivots between a first position and a second position, such as the unloaded position and the loaded position, with respect to archery bow 15. As shown in FIG. 21, archery bow 15 has cables 17, which are common elements in conventional compound archery bows.

As shown in FIGS. 1–6, bracket 23 is used to connect or attach arrow rest 20 with respect to archery bow 15. Any other suitable bracket or mechanical structure can be used to fix the position of arrow rest 20 with respect to archery bow 15.

As shown in FIGS. 1–6, cam element 40 is fixed with respect to bow cable 17. In one embodiment of this invention, cam element 40 is attached to only one cable 17, such as cable 17 which moves in a generally downward direction, with respect to a vertically held archery bow 15, when bow string 18 is drawn away from archery bow 15 and into a loaded position.

Lever 50 is fixed with respect to support element 30. As shown in FIGS. 2–4, 11 and 12, a pivot end portion of lever 50 is clamped with respect to pivot shaft 26. A threaded screw is used to tighten and loosen the clamp structure of lever 50. Any other suitable mechanical attachment or connection can be used to fix lever 50 with respect to support element 30, so that both bodies move together. Any suitable gear train and/or lever lengths can be used to multiply the movement of support element 30 with respect to lever 50. As shown in FIGS. 1–6, support element 30 and lever 50 move together.

Because cam element 40 is fixed with respect to cable 17, as cable 17 moves in a direction generally parallel to its longitudinal axis, cam element 40 moves between the positions shown in FIGS. 1 and 2. The position shown in FIG. 1 relates to bow string 18 not drawn back or in an at rest position with respect to archery bow 15. In the unloaded position of arrow rest 20, support element 30 is in the unloaded position where support element 30 does not contact arrow 16.

As bow string 18 is drawn back away from archery bow 15, cable 17 moves in a generally downward direction, such as from the position of FIG. 1 to the position of FIG. 2. During the generally downward and upward movement, cam element 40 rides on lever 50. Such movement and contact between cam element 40 and lever 50 cause lever 50 to rotate about pivot shaft 26. Because support element 30 and lever 50 move together, support element 30 contacts, lifts and moves arrow 16 into a loaded position, as shown in FIG. 2.

As arrow 16 is discharged from archery bow 15, cable 17 moves upward, relative to the orientation shown in FIGS. 1–6, and allows support element 30 to return to the unloaded position. In one embodiment of this invention, support element 30 is urged into the unloaded position by a bias force or another suitable spring force. Adjustment device 35 can be used to apply the bias force so that support element 30 normally moves into the unloaded position shown in FIG. 1. U.S. Pat. No. 6,050,251, the entire teachings of which are incorporated into this specification by reference to U.S. Pat. No. 6,050,251, teaches an apparatus for adjustably mounting a pivotal arrow rest, which can be used as adjustment device 35 according to this invention. Any other suitable adjustment device that varies the spring tension, that applies a spring force to direct support element 30 towards the unloaded position, that changes a horizontal or vertical component of a shooting window, or the like, can be used as adjustment device 35 of this invention.

As bow string 18 is released to discharge arrow 16 from archery bow 15, cable 17 to which cam element 40 is attached instantaneously or immediately moves upward, in the direction from the position shown in FIG. 2 to the position shown in FIG. 1, and allows support element 30 to instantaneously or immediately return to the unloaded position. The bias force applied to support element 30 can be selected large enough to instantaneously or immediately move support element 30 back to the unloaded position, during discharge of arrow 16, so that the shaft and the fletching of arrow 16 clear support element 30 and do not interfere with the flight path of arrow 16.

FIGS. 1–6 show base portion 31 of support element 30 detachably mounted with respect to pivot shaft 26. As shown in FIGS. 1–6, two arms 32 extend outward from base portion 31 and then away from each other, to form a fork or prong configuration. Any other suitable mechanical structure that supports arrow 16 can be used for support element 30 of this invention.

Cam element 40 is preferably detachably secured to cable 17. FIGS. 7–10 show different views of cam element 40, according to one embodiment of this invention. As shown in the side view of FIG. 7, body 42 forms cam surface 44. The shape of cam surface 44 can be designed or selected to achieve a desired responsive movement of lever 50 and thus of support element 30. Cam element 40 and lever 50, in one embodiment of this invention, act together as a cam-follower combination and many different cam-follower combinations known to those skilled in the art of mechanical linkages can be used with or in lieu of cam element 40 and lever 50.

As shown in FIGS. 7–10, cover 55 is detachably attached to body 42. In another embodiment of this invention, cover 55 can be integrated with body 42. As shown in FIGS. 7–10, two screws 56 are used to draw cover 55 towards body 42 and thus sandwich or clamp or pinch cable 17 between cover 55 and body 42.

Figure 8:
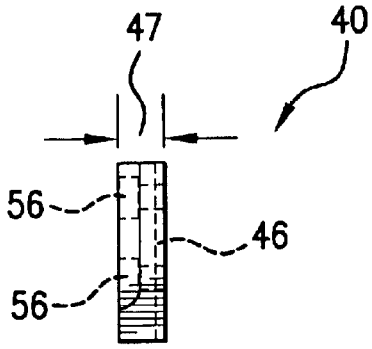
FIG. 8 is a rear view of the cam element, as shown in FIG. 7.
Figure 9:
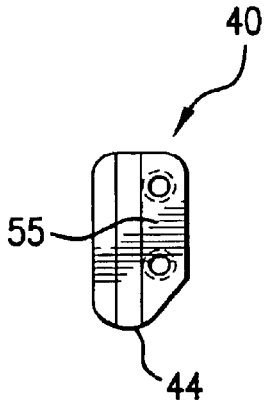
FIG. 9 is a side view, opposite the side view shown in FIG. 7, of the cam element as shown in FIG. 7.
Figure 10:
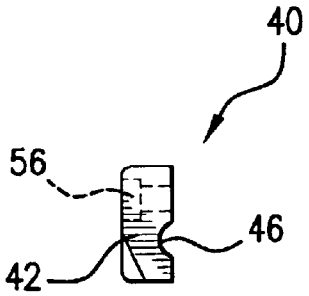
FIG. 10 is a top view of the cam element, as shown in FIG. 7.

FIG. 8 shows a longitudinal axis of groove 46 and a side of body 42 forming acute angle 47. Because some cables 17 on conventional archery bows 15 are angled with respect to the vertical, when the archery bow is held in a vertical plane, the longitudinal axis of groove 46 follows acute angle 47 with respect to the vertical plane, which may be in the range of about 1°–5°, often about 2°.

As shown in FIG. 8, both screws 56 can be directed from one side of body 42. Such arrangement can reduce a crushing effect on cable 17.

FIGS. 1–6 show cam element 40 having a relatively simple design, with a generally cylindrical body 42. Any other suitable shape or design of body 42 can be used to provide different cam surfaces 44. Also, as shown in FIGS. 1–10, the contacting surface of lever 50 is relatively planar but the contacting surface can be shaped or otherwise designed to provide different following action resulting from movement of cam element 40.

Figure 11:
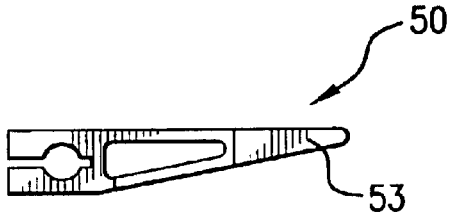
FIG. 11 is a side view of a lever or cam follower, according to one embodiment of this invention.
Figure 12:
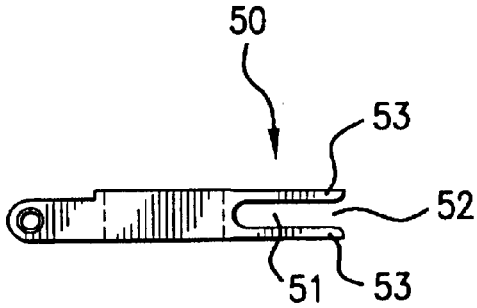
FIG. 12 is a top view of the lever or cam follower, as shown in FIG. 11.

FIGS. 11 and 12 show a side view and a top view, respectively, of lever 50, according to one embodiment of this invention. As shown in FIG. 12, free end portion 53 of lever 50 has a fork configuration. With the fork configuration shown in FIG. 12, void 51 is formed between the prongs of the fork configuration. Lever 50 can have any other suitable configuration that preferably forms void 51. Also as shown in FIG. 12, lever 50 has open end 52, for easy entry of cable 17.

Void 51 is preferably sized large enough to prevent interference between lever 50 and cable 17 when support element 30 moves between the unloaded position and the loaded position. As shown in and according to the orientation of FIG. 5, support element 30 is in the unloaded position and cable 17 is positioned to the far right within void 51. As cable 17 moves downward into the loaded position, cable 17 and thus cam element 40 move from right to left, as shown from FIGS. 5 to 6. Thus, as shown in and according to the orientation of FIG. 6, in the loaded position, cable 17 is in the far left portion of void 51. Thus, void 51 is preferably sized large enough to accommodate such movement. Also, void 51 is long or deep enough to accommodate a forward to backward movement through which cable 17 and thus cam element 40 travel, such as shown between FIGS. 3 and 4.

FIGS. 13–20 show different views of arrow rest 20, according to another embodiment of this invention. Many of the components between the embodiments shown in FIGS. 13–20 and the embodiments shown in FIGS. 1–6 are similar to each other and function in a similar manner. In the embodiments shown in FIGS. 13–20, lever 50 and cam element 40, function to produce the same or similar result of moving support element 30 in response to movement of cable 17. However, the particular configuration of lever 50 and cam element 40 is somewhat different, but it still can accommodate the two-dimensional or the three-dimensional movement of cam element 40 between the unloaded position and the loaded position.

Figure 13:
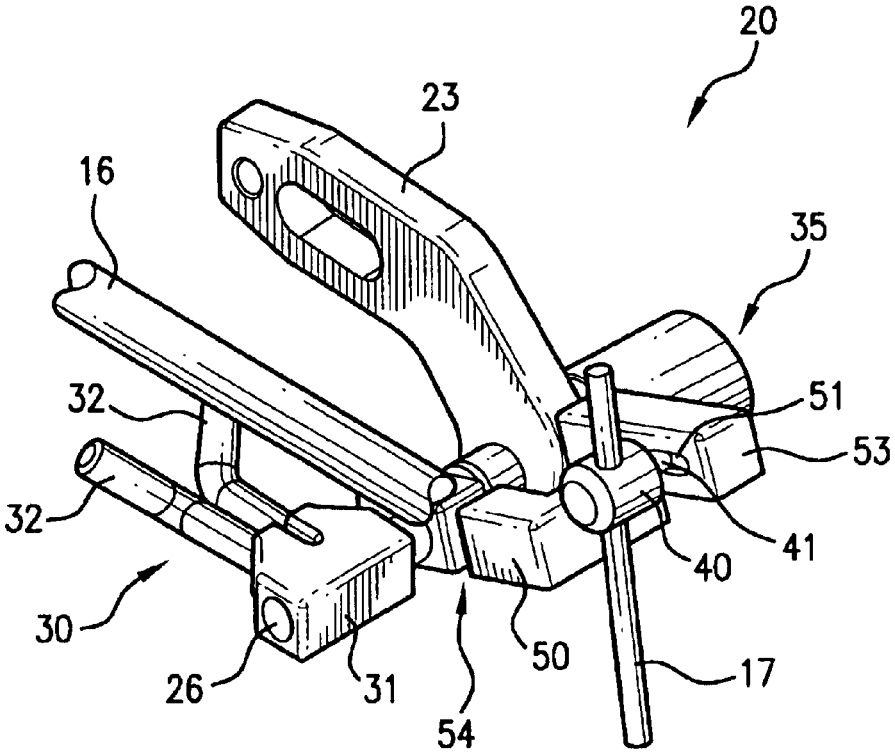
FIG. 13 is a perspective view of a moveable arrow rest, in an unloaded position, according to another embodiment of this invention.
Figure 14:
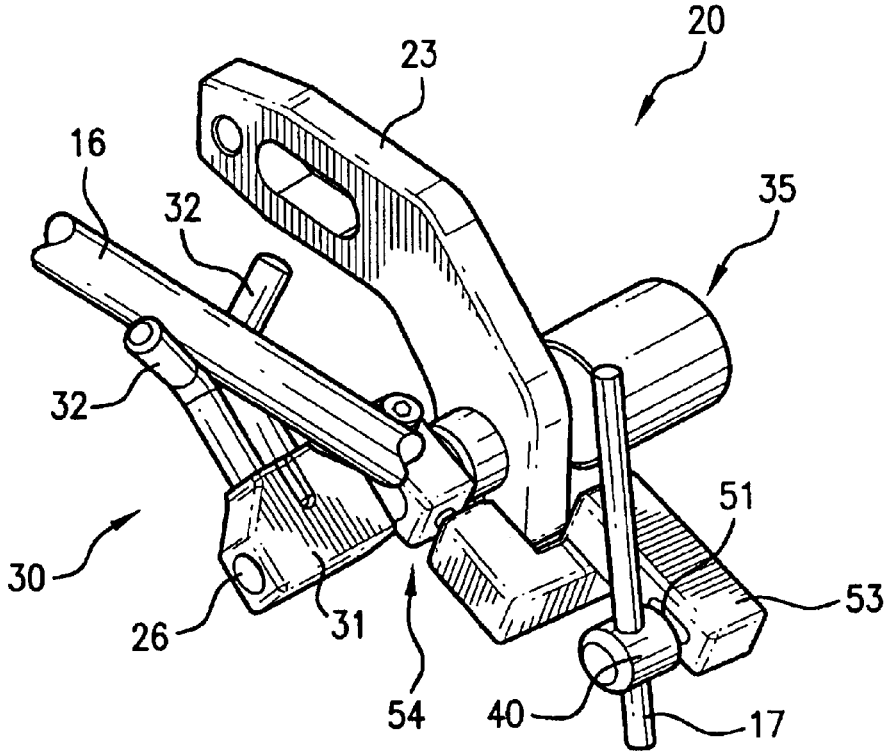
FIG. 14 is a perspective view of the arrow rest shown in FIG. 13, but in a loaded position.
Figure 15:
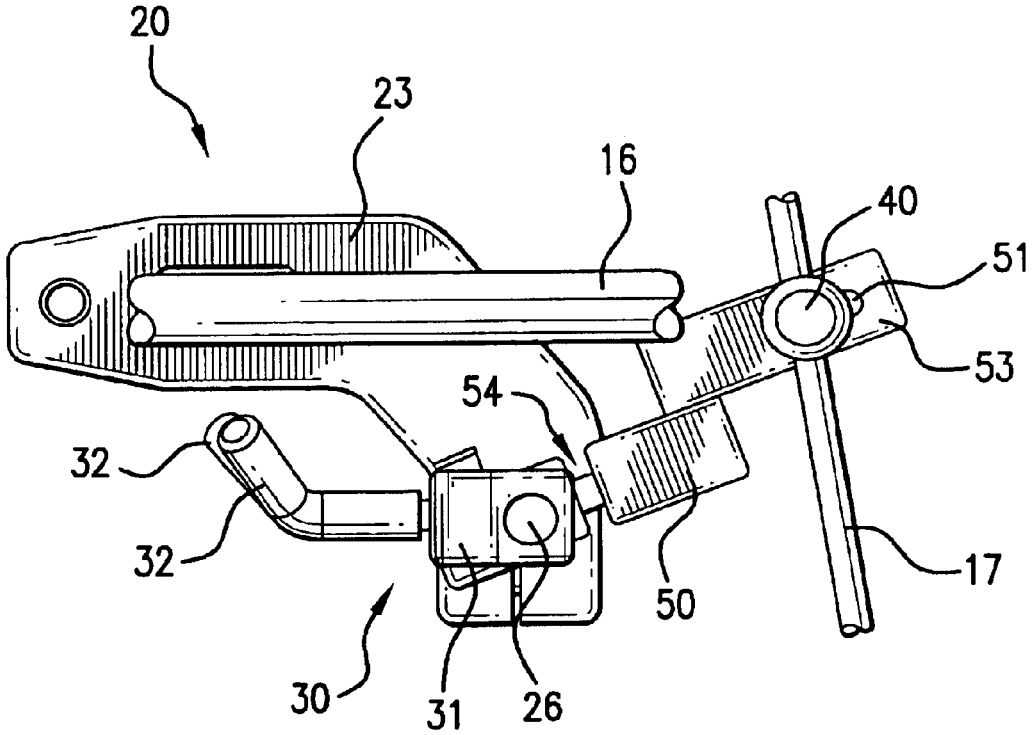
FIG. 15 is a side view of the arrow rest as shown in FIG. 13, in the unloaded position.
Figure 16:
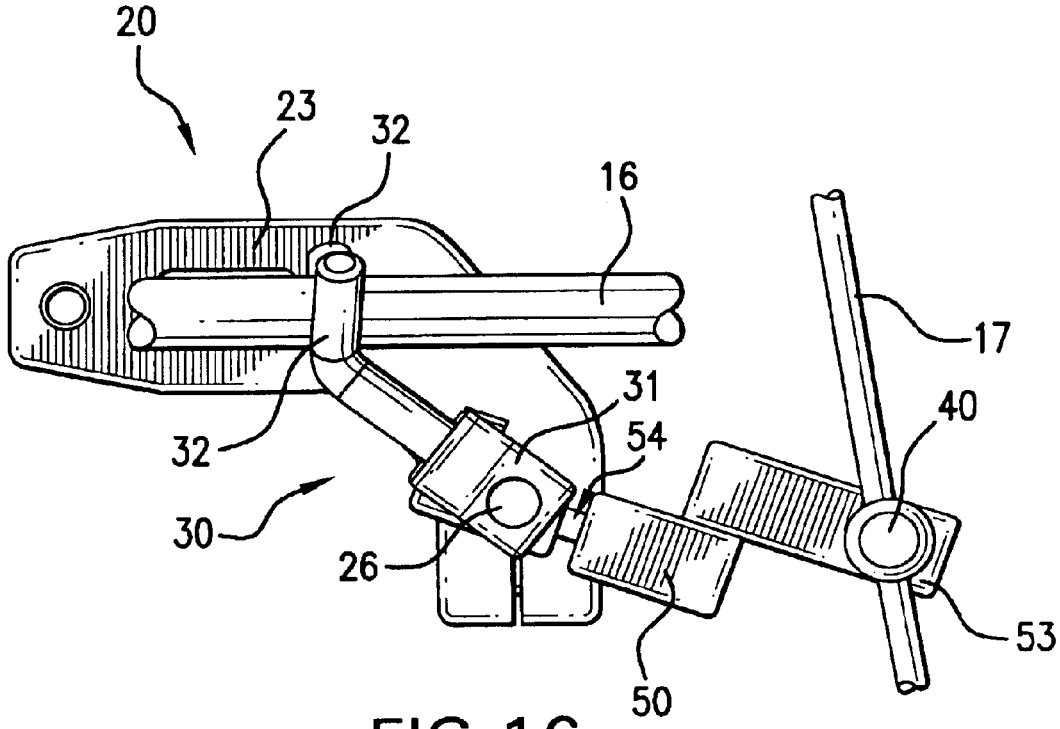
FIG. 16 is a side view of the arrow rest as shown in FIG. 14, in the loaded position.
Figure 17:
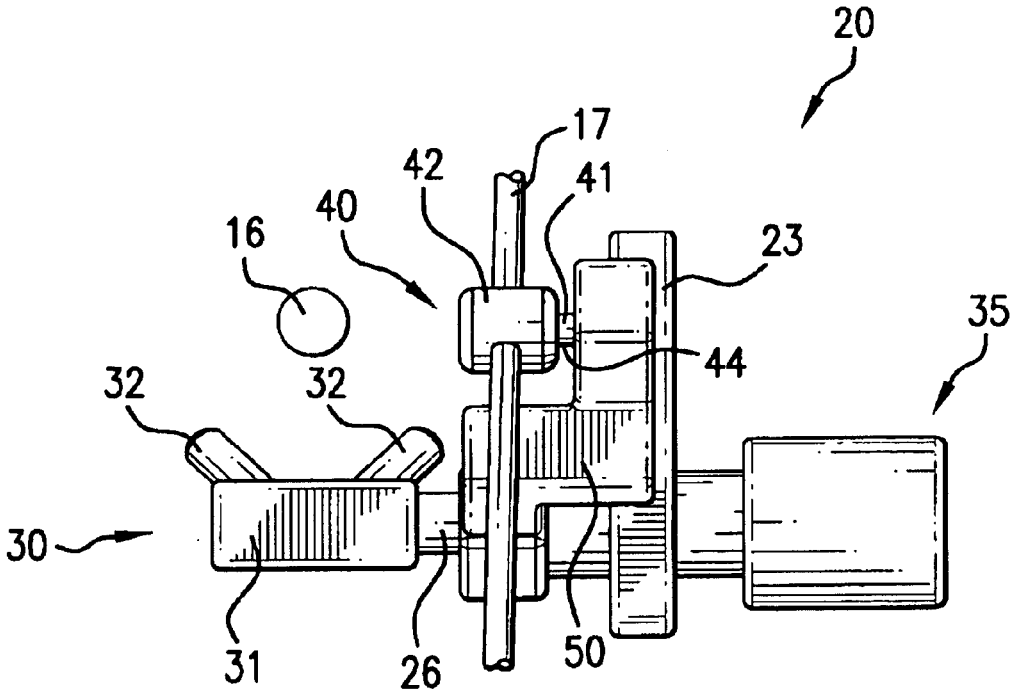
FIG. 17 is a rear view of the arrow rest shown in FIG. 13, in the unloaded position.
Figure 18:
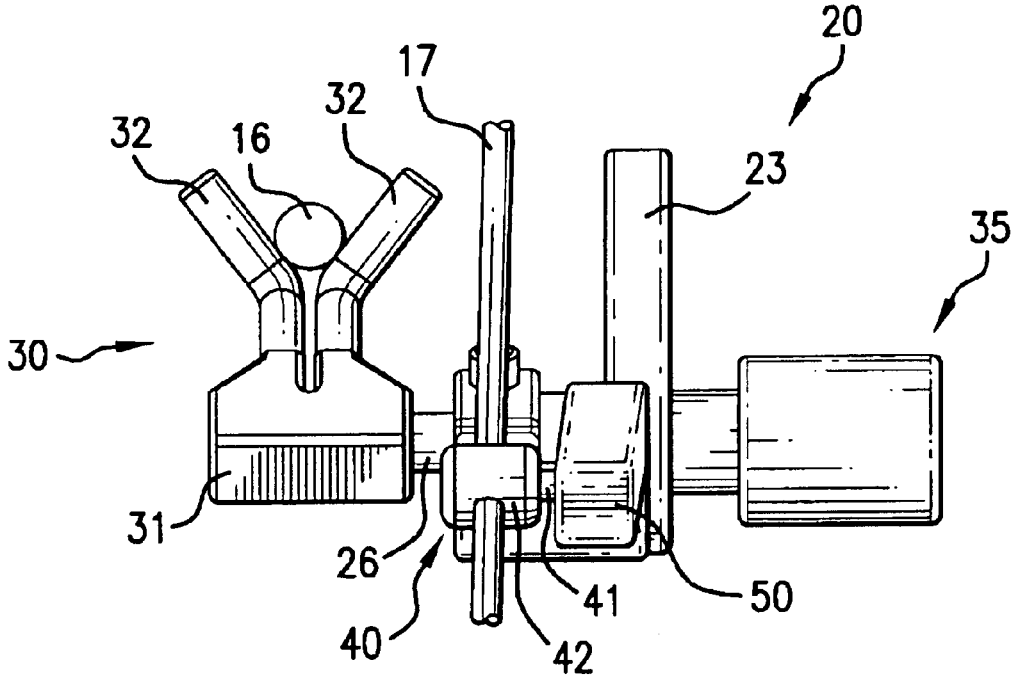
FIG. 18 is a rear view of the arrow rest shown in FIG. 14, in the loaded position.
Figure 19:
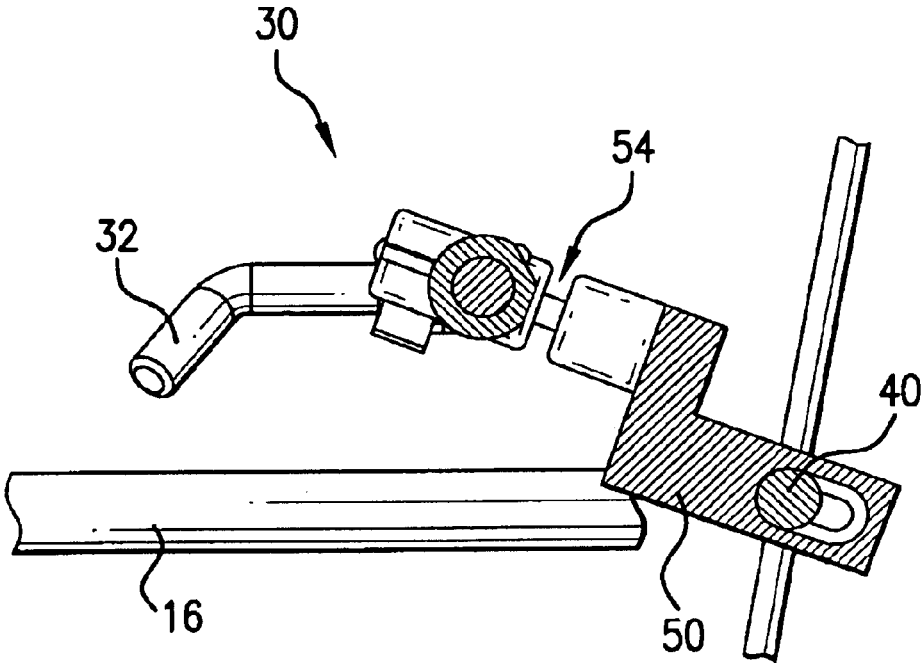
FIG. 19 is a inverted mirror section of the arrow rest as shown in FIGS. 13–18, taken in a direction generally parallel to a longitudinal axis of the arrow.
Figure 20:
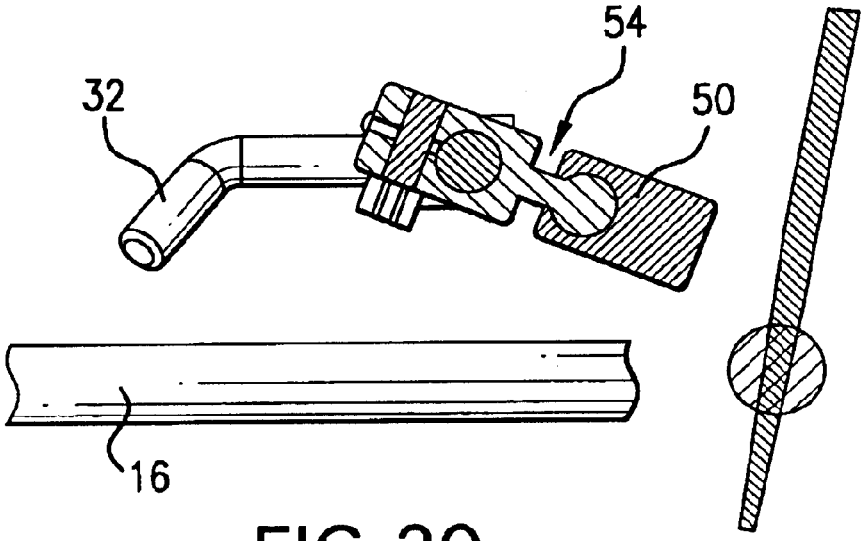
FIG. 20 is a inverted mirror section of the arrow rest as shown in FIGS. 13–18, taken in a direction generally parallel to the longitudinal axis of arrow 16, at a location different than FIG. 19.

As shown in FIGS. 13 and 14, cam element 40 comprises rod 41, which is attached to or integrated with body 42. As shown in FIGS. 13 and 14, rod 41 fits within void 51 of lever 50. As shown in FIGS. 13–18, lever 50 has a particular structural configuration. However, lever 50 can have any other suitable structural shape or configuration.

In this particular embodiment, cable 17 does not necessarily ride within void 51 of lever 50, but rather cam element 40 and/or rod 41 ride within void 51. As shown in FIGS. 13–16 and 20, lever 50 has ball-and-joint connection 54, which provides additional freedom of movement. In such embodiment, between cam element 40, rod 41, lever 50, void 51 and ball-and-joint connection 54, it is possible to achieve freedom of movement in three dimensions. Thus, with this embodiment it is also possible to translate the non-linear two-dimensional or three-dimensional movement of cam element 40 between the unloaded position and the loaded position, into pivotal or other movement of support element 30.

With many conventional archery bows 15, a point on cable 17, such as an attachment point between cam element 40 and cable 17, moves in two or three dimensions between the unloaded position such as shown in FIGS. 1, 3 and 5, and the loaded position, such as shown in FIGS. 2, 4 and 6. During movement between the unloaded position and the loaded position, cam element 40 moves within two or three dimensions.

The elements of this invention can be constructed with any suitable material, such as a polymer, a rubber, a metal, or any other suitable non-metal material. The elements of this invention can also be constructed of any suitable composite material.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

What is claimed is:

1. In an arrow rest having a support element that moves between a first position and a second position with respect to an archery bow, and the archery bow having a bow cable, the improvement comprising:

a cam element fixed with respect to the bow cable, a lever fixed with respect to the support element, and a cam surface of said cam element contacting said lever.

2. In the arrow rest according to claim 1, wherein the cam element moves between a third position and a fourth position as the support element moves between the first position and the second position.

3. In the arrow rest according to claim 1, wherein the cam element moves in two dimensions relative to the archery bow when the support element moves between the first position and the second position.

4. In an arrow rest having a support element that moves between a first position and a second position with respect to an archery bow, and the archery bow having a bow cable, the improvement comprising;

a cam element fixed with respect to the bow cable, a lever fixed with respect to the support element, and a cam surface of said cam element contacting said lever, and the cam element detachably secured to the bow cable.

5. In the arrow rest according to claim 4, wherein the cam element comprises a body forming the cam surface.

6. In the arrow rest according to claim 5, further comprising a cover detachably attached to the body.

7. In the arrow rest according to claim 6, wherein at least one screw detachably attaches the cover and the body.

8. In the arrow rest according to claim 6, wherein a plurality of screws detachably attach the cover and the body with respect to each other, and screw heads of all of the screws are positioned on one side of the body.

9. In the arrow rest according to claim 5, wherein the body forms a groove and the bow cable fits within the groove.

10. In the arrow rest according to claim 9, wherein a longitudinal axis of the groove forms an acute angle with respect to a side surface of the body.

11. In an arrow rest having a support element that moves between a first position and a second position with respect to an archery bow, and the archery bow having a bow cable, the improvement comprising:

a cam element fixed with respect to the bow cable, a lever fixed with respect to the support element, and a cam surface of said cam element contacting said lever, and the lever forming a void and the bow cable positioned within the void.

12. In the arrow rest according to claim 11, wherein the void is sized large enough to prevent interference between the lever and the cable when the support element moves between the first position and the second position.

13. In the arrow rest according to claim 11, wherein the void is shaped as a slot.

14. In the arrow rest according to claim 11, wherein the lever forms an open end and the open end forms a portion of the void.

15. In the arrow rest according to claim 11, wherein a free end portion of the lever has a fork configuration.

16. In the arrow rest according to claim 15, wherein the void is formed between prongs of the fork configuration.

17. In an arrow rest having a support element that moves between a first position and a second position with respect to an archery bow, and the archery bow having a bow cable, the improvement comprising;

a cam element fixed with respect to the bow cable, a lever fixed with respect to the support element, and a cam surface of said cam element contacting said lever, and the cam element having an overall cylindrical shape.

18. In an arrow rest having a support element that moves between a first position and a second position with respect to an archery bow, and the archery bow having a bow cable, the improvement comprising:

a cam element fixed with respect to the bow cable, a lever fixed with respect to the support element, and a cam surface of said cam element contacting said lever, and at least a portion of the cam element positioned in a void of the lever.

19. In an arrow rest having a support element that moves between a first position and a second position with respect to an archery bow, and the archery bow having a bow cable, the improvement comprising:

a cam element fixed with respect to the bow cable, a lever fixed with respect to the support element, and a cam surface of said cam element contacting said lever, and the cam element moving in three dimensions relative to the archery bow when the support element moves between the first position and the second position.

* * * * *